US005131807A

United States Patent [19]

Fischer et al.

[11] Patent Number: 5,131,807

[45] Date of Patent: Jul. 21, 1992

[54] REVERSE PITOT AIR FILTER

[75] Inventors: Richard L. Fischer, Rolling Hills Estates; Ramesh C. Doshi, La Palma; Terence P. Emerson, Hermosa Beach, all of Calif.

[73] Assignee: Allied-Signal Inc., Morris Township, Morris County, N.J.

[21] Appl. No.: 554,043

[22] Filed: Jul. 16, 1990

[51] Int. Cl.[5] ..... F04D 29/70

[52] U.S. Cl. ..... 415.0/121.2; 415/111; 415/169.2; 417/407

[58] Field of Search ..... 415/110, 111, 112, 113, 415/121.2, 169.2; 417/407; 55/17, 447, 449, DIG. 14; 73/861.65

[56] References Cited

U.S. PATENT DOCUMENTS

| | | | |
|---|---|---|---|
| 2,405,625 | 8/1946 | Whiton et al. | 55/449 |
| 2,592,423 | 1/1952 | Foley | 55/449 |
| 2,625,240 | 1/1953 | McBride et al. | 55/449 |
| 2,812,828 | 11/1957 | Yellott et al. | 55/449 |
| 3,085,382 | 4/1963 | Finney, Jr. et al. | 55/449 |
| 3,169,842 | 2/1965 | Streete et al. | 55/449 |
| 3,212,240 | 10/1965 | Streete | 55/449 |
| 3,740,163 | 6/1973 | Schinnerer et al. . | |

FOREIGN PATENT DOCUMENTS

| | | | |
|---|---|---|---|
| 1000183 | 8/1965 | United Kingdom | 55/447 |

*Primary Examiner*—Edward K. Look
*Assistant Examiner*—James A. Larson
*Attorney, Agent, or Firm*—David B. Abel; Terry L. Miller; Robert A. Walsh

[57] ABSTRACT

An inertial filter includes a pitot or probe extending into the main stream of a turbomachinery scroll, an open end portion of the probe being directed downstream. The probe also includes a cowling to orient or inertially swirl the airflow about the probe.

8 Claims, 3 Drawing Sheets

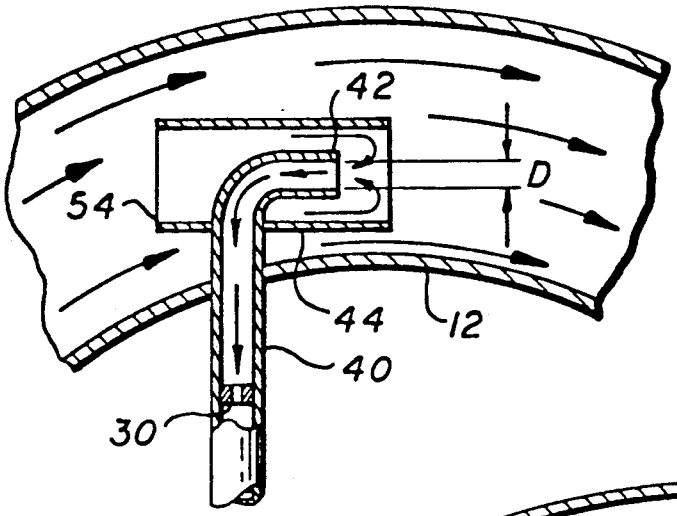
FIG. 4
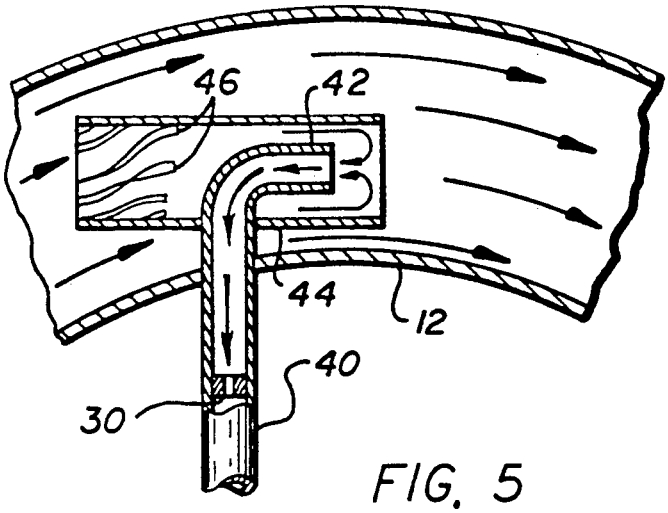
FIG. 5
FIG. 5A
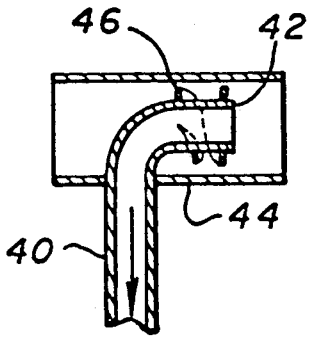
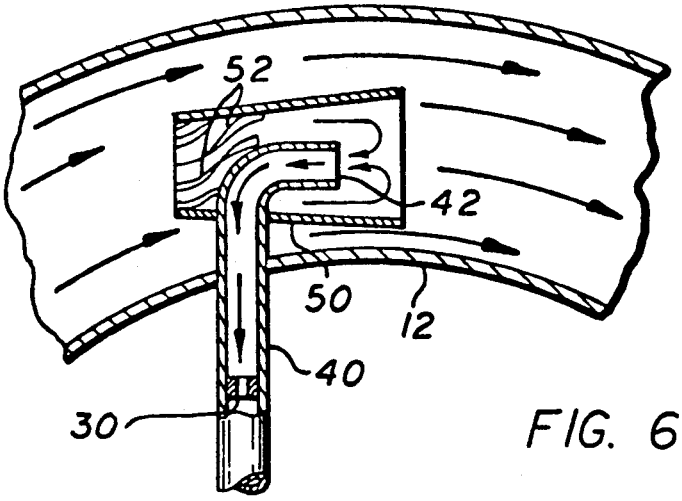
FIG. 6

FIG. 7

| CONDITION | FILTRATION EFFICIENCY | |
|---|---|---|
| | REVERSE PITOT OF FIG. 1 | IMPROVED PITOT OF FIG. 4 |
| SAND & DUST INGESTED WITH DRY AIR | 97% | 99.5% |
| SAND & DUST INGESTED WITH MOIST AIR | 67% | 98.5% |
| OIL INGESTED WITH DRY AIR | 49% | 99.9% |

REVERSE PITOT AIR FILTER

BACKGROUND OF THE INVENTION

For many years, air or gas (fluid) bearings have been a natural candidate for high speed turbomachinery design because of the convenience and simplicity of utilizing the process fluid, plant air and/or the ambient atmosphere as a bearing fluid or lubricant. While the process fluid is most readily available as the lubricant, it is oftentimes impure, typically containing various quantities of water, dirt, and/or other contaminants. While fluid bearings have significant advantages, such as design simplicity, relaxation of maintenance and servicing requirements, easing of temperature limitations, low noise, longer bearing life and in some cases reduced friction, these bearings are particularly sensitive to contamination in view of the tight clearances and dimensional controls required.

SUMMARY OF THE INVENTION

The present invention is directed to an inertial filter for use in fluid bearing applications, for example, high speed open-cycle air-cycle turbomachines installed on mobile platforms such as aircraft, trucks, tractors and ships. Such equipment includes aircraft air conditioning cooling turbines, turbochargers, gas turbines, motor-driven compressors and the like. The inertial filter draws off fluid from the turbomachinery scroll and supplies such fluid to the fluid bearings which support the rotating parts of the turbomachinery.

The inertial filter includes a pitot or probe extending into the main stream of a turbomachinery scroll, an open end portion of the probe being directed downstream. The probe also includes a cowling to orient or inertially swirl the airflow about the probe.

BRIEF DESCRIPTION OF THE DRAWINGS

FIG. 4 is a schematic, partially cross-sectional representation of the inertial filter of the present invention.

FIGS. 5 and 5A are a schematic, partially cross-sectional representation of an alternative embodiment of the inertial filter of the present invention.

FIG. 6 is a schematic, partially cross-sectional representation of a second alternative embodiment of the inertial filter of the present invention.

FIG. 7 is a graphical representation of the efficiency of the inertial filter of the present invention a opposed to the inertial filter of the prior art.

DESCRIPTION OF THE PREFERRED EMBODIMENTS

Figure 1:
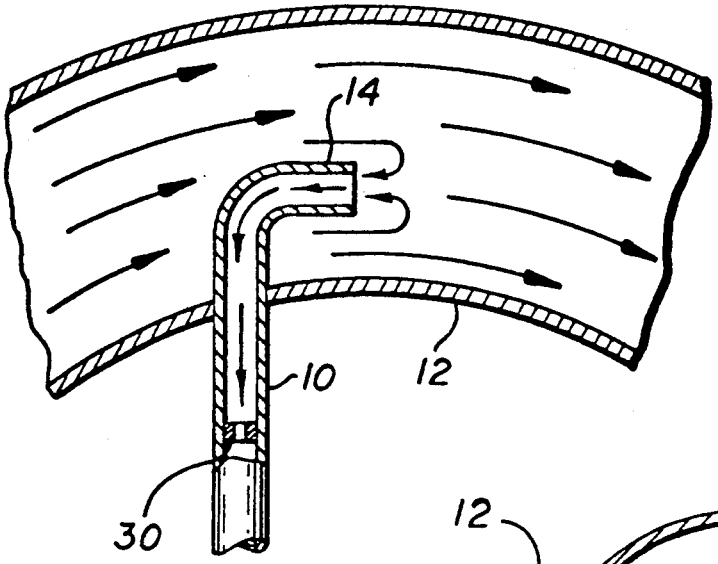
FIG. 1 PRIOR ART
FIG. 1 is a schematic side representation of the inertial filter in a turbomachinery scroll of the prior art.
Figure 2:
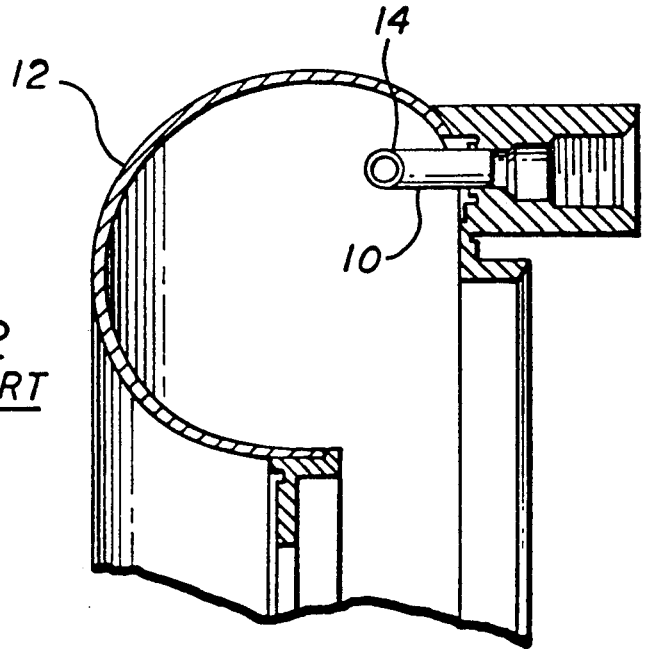
FIG. 2 PRIOR ART
FIG. 2 is an end view partially in section of the inertial filter in a turbomachinery scroll of the prior art.

As illustrated in FIG. 1, the inertial filter of the prior art generally comprises a probe 10 extending into the main air stream of a turbomachinery scroll 12. The open end portion 14 of the probe 10 is directed downstream such that the flow of air through the open end 14 of the probe 10 is forced to turn approximately 180° before entering the probe 10. A flow restricting orifice 30 would normally be included in the probe 10 to control the air flow therethrough. FIG. 2 illustrates an end view of the prior art probe 10 within the turbomachinery scroll 12.

The axis of the downstream extending portion 14 of probe 10 is normally parallel to the air flow stream lines of the main stream flow in the turbomachinery scroll 12. Thus, any air entering the downstream end of the tube 14 must essentially reverse direction before entering the probe and dry particles in such fluid would not be able t enter the probe since their momentum would carry them with the primary flow past the probe. However, when the air stream contains either water vapor or oil vapor, the efficiency of the inertial filter of the prior art as depicted in FIGS. 1 and 2 is dramatically reduced.

Figure 3:
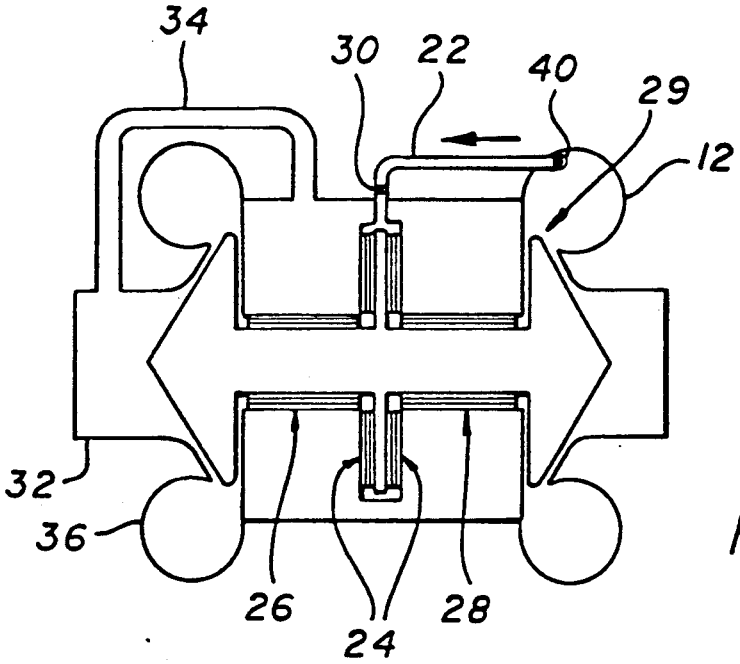
FIG. 3 is a schematic view of an inertial filter in a turbomachinery fluid bearing application.

In the fluid bearing application shown in FIG. 3, a pitot 40 taps air from the turbine scroll 12. This air is supplied through an air supply line 22 to thrust bearings 24 and journal bearings 26 and 28 which support a rotating assembly 29. Orifice 30 in air supply line 22 controls the air pressure to the bearings 24, 26, and 28. The air proceeds first to the thrust bearings OD, passes through the thrust bearings from OD to ID and then proceeds axially outward through the journal bearings 26 and 28. It is then discharged into the inlet 32 of the compressor 36 through discharge line 34. The bearing ambient pressure is thus maintained at compressor inlet pressure. Preferably, the thrust bearings 24 and journal bearings 26, 28 are gas foil bearings including thin compliant foils which support the rotating assembly 29 on a film of pressurized air. In this configuration, the purity or cleanliness of the air flow taped from the turbine scroll 12 is critical to maintaining the effectiveness of the bearings 24, 26 and 28.

Accordingly, FIGS. 4, 5 and 6 depict improved reverse pitot assemblies which provide increased separation of moisture and oil vapor entrained contaminants. In FIG. 4, the improved pitot 40 is depicted extending into the turbomachine scroll 12. The improved pitot 40 includes an open end 42 which is directed downstream within the air flow path. Additionally, a cowling or flow directing tube 44 is mounted about the open end 42 portion of the pitot 40. The flow directing tube 44 may be simply a straight-axis tube having a constant diameter which is preferably coaxially mounted with respect to the open end of the pitot 40. In this configuration, the air flow through the tube 44 is "straightened" to minimize the amount of swirling which may occur within the free stream of the turbine scroll 12.

Additionally, the flow directing tube 44 includes an opening 54 at the upstream end thereof. The opening 54 encompasses a fluid flow-receiving area considerably larger than the equivalent area defined by the outer diameter of the pitot tube 40. However, as seen viewing FIG. 4, the pitot tube 40 partially obstructs fluid flow through tube 44 downstream of the opening 54 thereof. Those ordinarily skilled in the pertinent arts will recognize that because the area available for fluid flow outside of tube 40 and within tube 44 (i.e., between these two tubes) is less than the area at opening 54 according to the effective area of the outer diameter of tube 40, the fluid flow accelerates between tubes 40 and 44. Thus, in addition to being "straightened," the fluid flow in tube 44 is accelerated above the free-stream velocity in scroll 12. As depicted by the arrows entering opening 42, fluid must reverse direction immediately downstream of the end of tube 40 in order to enter opening 42 and flow therethrough. Particulates and moisture cannot generally follow this abrupt direction reversal and are excluded from the opening 42. Because the cooperation of tubes 40 and 44 accelerates the air flow therebetween above the free stream velocity by area reduction of the bounded fluid stream immediately upstream of opening 42, the abrupt direction reversal at the downstream end of tube 40 is even more effective at excluding particulates and moisture.

FIG. 5 depicts an alternate embodiment of the flow directing tube 44 of FIG. 4 wherein the flow directing tube 44 includes swirl vanes 46 positioned within the interior of the flow directing tube 44 upstream of the pitot 40. Alternatively, the swirl vanes 46 could be mounted about the pitot 40 as shown in FIG. 5*a*. In this configuration, the swirl vanes 46 promotes swirling of the air flowing through the flow directing tube 44, thereby inertially directing the heavier moisture laden particles toward the inner circumference of the flow directing tube 44 away from the open end 42 of the pitot 40. A third alternate embodiment of the present invention is depicted within FIG. 6 in which the pitot 40 is surrounded by a cowling 50 which includes preswirl vanes 52 upstream of the pitot 40 and in addition, the cowling 50 is configured to have a conical shape to thereby further promote the flow of the heavier moisture laden particles towards the inner circumference of the cowling 50 and away from the open end 42 of pitot 40.

Within each of the embodiments of FIGS. 4–6, there are several variables which contribute to the quality of the air tapped from the turbine scroll, these include the diameter of the pitot tube 40, the diameter of the flow directing tube 44 or cowling 50, the length of the flow directing tube 44 or cowling 50, the offset of the center lines between the flow directing tube 44 or cowling 50 and the open end 42 of pitot 40 and the flow velocity of the air flow through the flow directing tube 44 or cowling 50. Generally, for a pitot 40 having a diameter D, the preferred range of diameters for the flow directing tube 44 is from 2D to 10D. In the case of cowling 50, the conical shape is preferably increased by an amount approximately equal to D at the downstream end of the cowling 50. It is also preferable that the straightener tube 44 or cowling 50 extend at least 2D downstream of the end of the open end 42 of pitot 40. In addition, the flow directing tube 44 or cowling 50 should preferably extend a length greater than 4D upstream of the open end 42 of the pitot 40.

The effectiveness of the incorporation of flow directing tube 44 as depicted in FIG. 4 without the benefit of swirl vanes 46, is illustrated within the table of FIG. 7. Therein, the filtration efficiency as measured by the weight of the contaminants in the supply air minus the weight of the contaminants in the filtered air divided by the weight of contaminants in the supply air times 100 is reproduced for three varying conditions and tests performed with the configuration of the prior art as depicted as in FIG. 1 as compared to the configuration of the present invention as shown in FIG. 4. In the first test, sand and dust were ingested into a dry air stream. The reverse pitot 10 of FIG. 1 shows a 97% efficiency as compared to a 99.5% efficiency for the reverse pitot 40 with flow directing tube 44 of FIG. 4. In the second test, sand and dust was ingested with moist air. The prior art reverse pitot 10 showed a 67% efficiency as compared to a 98.5% efficiency for the reverse pitot 40 of the present invention. In the third test, oil was ingested with dry air. The prior art reverse pitot 10 showed a 49% efficiency as compared to a 99.9% removable efficiency for the reverse pitot 40 with flow directing tube 44 of the present invention. Thus, the reverse pitot 40 including the flow directing tube 44 of the present invention provides significantly higher filtration efficiencies for both the moist air and oil misted air test conditions. As may be appreciated this efficiency results in substantially cleaner operation of the turbomachinery and the gas foil bearings therein.

It should be evident from the foregoing description that the present invention provides many advantages over the reverse pitot air filter of the prior art. Although preferred embodiments are specifically illustrated and described herein, it will be appreciated that many modifications and variations of the present invention are possible in light of the above teachings to those skilled in the art. It is preferred, therefore, that the present invention be limited not by the specific disclosure herein, but only by the appended claims.

We claim:

1. A turbomachine comprising:

a casing positioned around said rotating assembly to direct a flow of process fluid upon said rotating assembly;

a process-fluid bearing rotatably supporting said rotating assembly within said casing;

flow path means for supplying a flow of said process fluid from said casing to said process-fluid bearing, said flow path means including a first tubular member extending inwardly of said casing and having an open end locally facing downstream of said process fluid flow;

an elongate second tubular member open at each end, mounted within said casing and intermediate its length coaxially encompassing said first tubular member, said first and said second tubular members cooperatively defining a flow channel therebetween of certain area, and said second tubular member upstream of said first tubular member having an upstream end receiving fluid flow and defining an inlet area greater than said certain area, whereby process fluid received into said open upstream inlet end of said second tubular member is accelerated through said flow channel of lesser certain area upstream of said open end of said first tubular member to a velocity above free-stream velocity.

2. The invention of claims 1 wherein said first tubular member has a diameter D, and said second tubular member has a diameter in the range from 2D to 10D.

3. The invention of claims 2 wherein said second tubular member has a length of at least 2D downstream of said open end of said first tubular member.

4. The invention of claim 2 wherein said second tubular member has a length at least 4D upstream of said open end of said first tubular member.

5. The invention of claim 1 wherein one of said first and said second tubular member further includes means for swirling process fluid received into said open upstream inlet end.

6. The invention of claim 5 wherein said means for swirling includes swirl vanes extending radially thereto within said second tubular member.

7. The invention of claim 1 wherein said second tubular member is additionally conical flaring in the upstream-to-downstream direction proximate the open end of said first tubular member.

8. A method of providing filtered gaseous fluid for use within gaseous fluid bearing rotatably supporting said rotating assembly, comprising:

providing an inertial filter to supply gaseous fluid to said fluid bearings, said inertial filter comprising a tubular member extending into a gaseous fluid flow stream and having an open end facing away from the direction of gaseous fluid flow; and preventing entrained moisture in said gaseous fluid from entering said open end of said inertial filter by mounting a flow directing member about said tubular member;

further including the steps of using said flow directing member to capture a portion of said gaseous fluid stream, and using cooperative flow-area reducing interaction of said flow directing member and said tubular member to accelerate said gaseous portion to a velocity at the open end of said tubular member greater than the remainder of said fluid stream, whereby a direction reversal of a fractional part of said fluid at said open end of said tubular member to enter therein is more effective in excluding particulates and moisture due to said increased velocity.

* * * * *